US011021816B2

(12) United States Patent
Goenka et al.

(10) Patent No.: US 11,021,816 B2
(45) Date of Patent: Jun. 1, 2021

(54) SOFT TWIST TERRY ARTICLE

(71) Applicant: Welspun India Limited, Maharashtra (IN)

(72) Inventors: Dipali Goenka, Maharashtra (IN); Rajender Sharma, Maharashtra (IN)

(73) Assignee: Welspun India Limited, Maharashtra (IN)

( * ) Notice: Subject to any disclaimer, the term of this patent is extended or adjusted under 35 U.S.C. 154(b) by 0 days.

(21) Appl. No.: 16/142,561

(22) Filed: Sep. 26, 2018

(65) Prior Publication Data

US 2019/0257011 A1 Aug. 22, 2019

(30) Foreign Application Priority Data

Feb. 21, 2018 (IN) ..... 201821006589

(51) Int. Cl.
*D03D 27/08* (2006.01)
*D02G 3/28* (2006.01)
*D03D 25/00* (2006.01)

(52) U.S. Cl.
CPC ..... *D03D 27/08* (2013.01); *D02G 3/28* (2013.01); *D03D 2700/0177* (2013.01); *D10B 2201/02* (2013.01); *D10B 2201/20* (2013.01); *D10B 2201/24* (2013.01)

(58) Field of Classification Search
CPC .... D03D 27/08; D03D 15/0027; D03D 27/00; D03D 1/0017; D03D 15/00; D03D 15/0077; D03D 27/06
See application file for complete search history.

(56) References Cited

U.S. PATENT DOCUMENTS 3,721,272 A * 3/1973 Hager ..... D03D 27/08 139/396
3,940,522 A * 2/1976 Wessells ..... D01D 5/253 428/17
4,340,631 A * 7/1982 Endo ..... D01D 5/20 428/359
5,667,865 A * 9/1997 Jackson ..... D03D 27/08 139/25
6,537,640 B1 * 3/2003 Nakamura ..... D03D 27/00 139/391
7,810,308 B2 10/2010 Wang
8,156,967 B2 * 4/2012 Huffstickler ..... D03D 27/08 139/21
8,733,075 B2 5/2014 Mandawewala
9,677,201 B2 * 6/2017 Mandawewala ..... D03D 15/06
9,677,202 B2 * 6/2017 Mandawewala ..... B32B 5/024
(Continued)

*Primary Examiner* — Robert H Muromoto, Jr.
(74) *Attorney, Agent, or Firm* — Offit Kurman, P.A.; Gregory A. Grissett

(57) ABSTRACT

A terry article includes a ground component including a plurality of ground warp yarns and a plurality of ground weft yarns interwoven with the plurality of ground warp yarns. The ground component includes a second side and a first side opposed to the second side along a vertical direction, as well as a pile component extending away from the ground component along the vertical direction. The pile component includes a plurality of plied yarns, where each of the plied yarns includes 1) a first yarn that has a first yarn count, and 2) a second yarn that has a second yarn count that is greater than the first yarn count. The second yarn includes regenerated cellulose fibers.

15 Claims, 4 Drawing Sheets

(56) References Cited

U.S. PATENT DOCUMENTS

| | | | | |
|---|---|---|---|---|
| 9,677,205 | B2 * | 6/2017 | Mandawewala | D02G 3/22 |
| 9,828,704 | B2 * | 11/2017 | Goenka | D03D 27/08 |
| 10,072,364 | B2 * | 9/2018 | Goenka | D03D 27/08 |
| 10,287,714 | B2 * | 5/2019 | Mandawewala | B32B 5/26 |
| 2002/0119281 | A1 * | 8/2002 | Higgins | D06N 7/0086 428/95 |
| 2002/0132085 | A1 * | 9/2002 | Higgins | D06N 7/0086 428/95 |
| 2005/0067042 | A1 * | 3/2005 | Hirota | D03D 27/06 139/426 R |
| 2006/0037154 | A1 * | 2/2006 | Goineau | D02G 1/00 8/478 |
| 2006/0277950 | A1 * | 12/2006 | Rock | A41D 13/002 66/169 R |
| 2012/0076971 | A1 * | 3/2012 | Debnath | D02G 3/04 428/85 |
| 2013/0037163 | A1 * | 2/2013 | Teshima | D02G 3/406 139/391 |
| 2014/0248461 | A1 * | 9/2014 | Mandawewala | D02G 3/02 428/76 |
| 2016/0333506 | A1 * | 11/2016 | Goenka | D03D 15/0027 |
| 2017/0073858 | A1 * | 3/2017 | Goenka | D03D 27/08 |
| 2017/0088986 | A1 * | 3/2017 | Gupta | D03D 27/08 |
| 2017/0103579 | A1 * | 4/2017 | Goenka | G06T 19/006 |
| 2017/0159233 | A1 * | 6/2017 | Gupta | D06C 17/00 |
| 2018/0347080 | A1 * | 12/2018 | Goenka | D03D 27/08 |

* cited by examiner

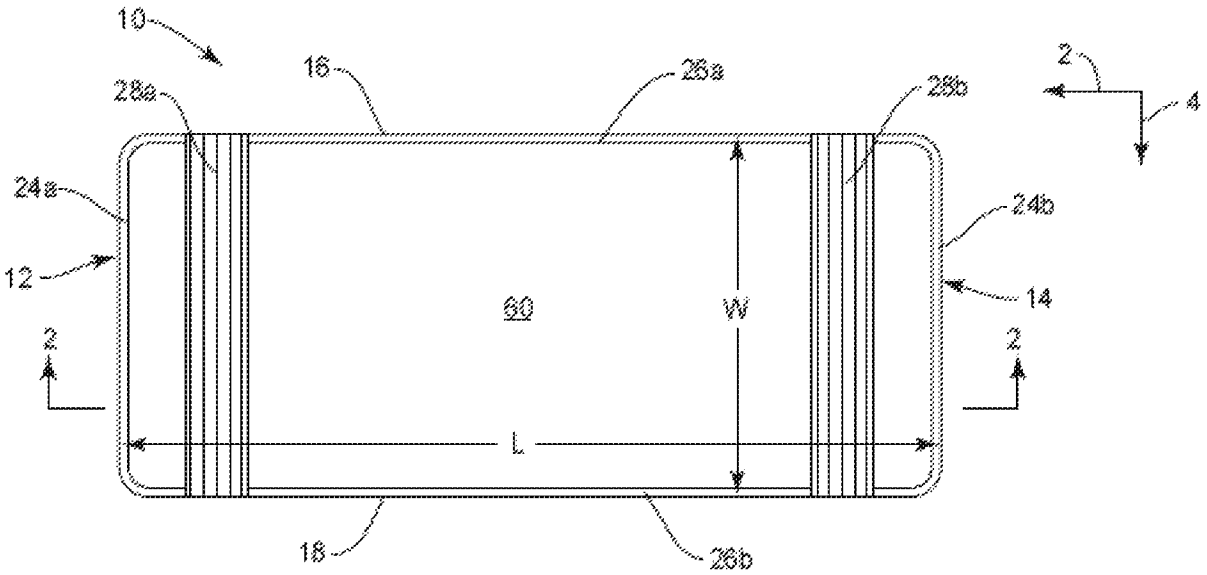
FIG. 1
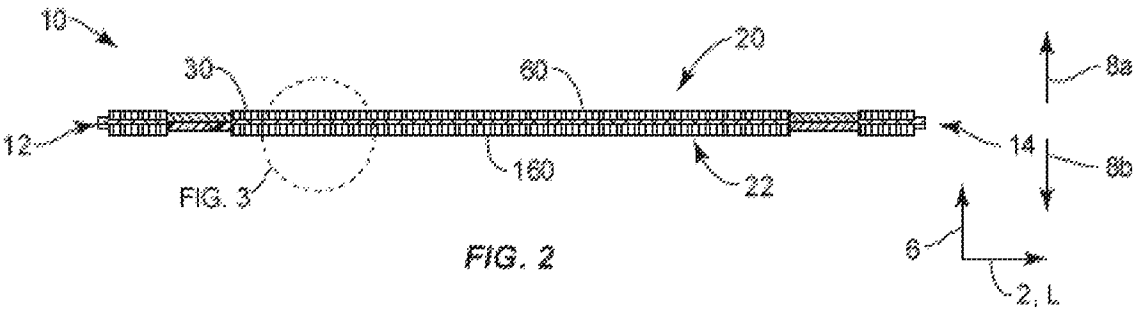
FIG. 2
FIG. 3

SOFT TWIST TERRY ARTICLE

CROSS-REFERENCE TO RELATED APPLICATIONS

The present application claims priority to and the benefit of Indian Patent Application No. 201821006589, filed Feb. 21, 2018, the entire disclosure of which is incorporated by reference into the present application for all purposes.

TECHNICAL FIELD

The present disclosure relates to articles formed from terry fabrics with soft twisted pile yarns and methods of making same.

BACKGROUND

Terry fabrics have a wide range of end uses. More common examples are towels, bath robes, rugs, top of the bed fabrics, bath mats, and seat covers. Terry fabrics include ground warp yarns, ground weft yarns interwoven with the ground warp yarns, and pile yarns that define piles on one or both sides of the fabric. Terry fabrics are cut to size, and hems or selvedges formed along the edges define the shape of the article. Terry fabric design takes into consideration end-use performance requirements and aesthetics. Design features that impact fabric properties and therefore contribute to performance of the fabric during use include fiber type, yarn type, yarn count, pile height, pile density, ground fabric structure, and fabric weight. Optimizing fabric structure for the end-use requirements is difficult and is not always a predictable endeavor. Certain terry articles are so called "low twist" towels and are bulky, soft and absorbent. Generally low twist towels are being made by using PVA yarn along with cotton yarn in pile during weaving and then dissolving the PVA fiber during processing to get a low twist yarn towel that achieves softness and bulkiness. In recent years, towels are being made by using 100% cotton in both thick and thin yarns to make a low twist yarn. See e.g. U.S. Pat. No. 7,810,308.

SUMMARY

An embodiment of the disclosure is a terry article that includes a ground component that includes a plurality of ground warp yarns and a plurality of ground weft yarns interwoven with the plurality of ground warp yarns. The ground component includes a second side and a first side opposed to the second side along a vertical direction. The terry article further includes a pile component extending away from the ground component along the vertical direction. The pile component includes a plurality of plied yarns, where each of the plied yarn includes a first yarn that has a first yarn count and a second yarn that has a second yarn count that is greater than the first yarn count. The second yarn includes regenerated cellulose fibers.

Another embodiment of the disclosure is a method of making a terry article. The method includes spinning a first yarn to have a first yarn count and spinning a second yarn to have a second yarn count, where the second yarn includes regenerated cellulosic fibers. The method also includes plying the first yarn and the second yarn together to form a plied yarn. The method further includes weaving a pile fabric including a ground component and a pile component disposed on at least one of a first side and a second side of the ground component. The pile component includes a plurality of piles formed with the plied yarn such that each pile includes a first yarn having the first yarn count, and a second yarn having the second yarn count that is greater than the first yarn count.

BRIEF DESCRIPTION OF THE DRAWINGS

The foregoing summary, as well as the following detailed description, will be better understood when read in conjunction with the appended drawings. The drawings show illustrative embodiments of the invention. It should be understood, however, that the application is not limited to the precise arrangements and instrumentalities shown.

FIG. 1 is a top view of a terry article according to an embodiment of the present disclosure;

FIG. 2 is a schematic cross-sectional view of the terry article shown in FIG. 1, shown along line 2-2;

DETAILED DESCRIPTION OF ILLUSTRATIVE EMBODIMENTS

Figure 3:
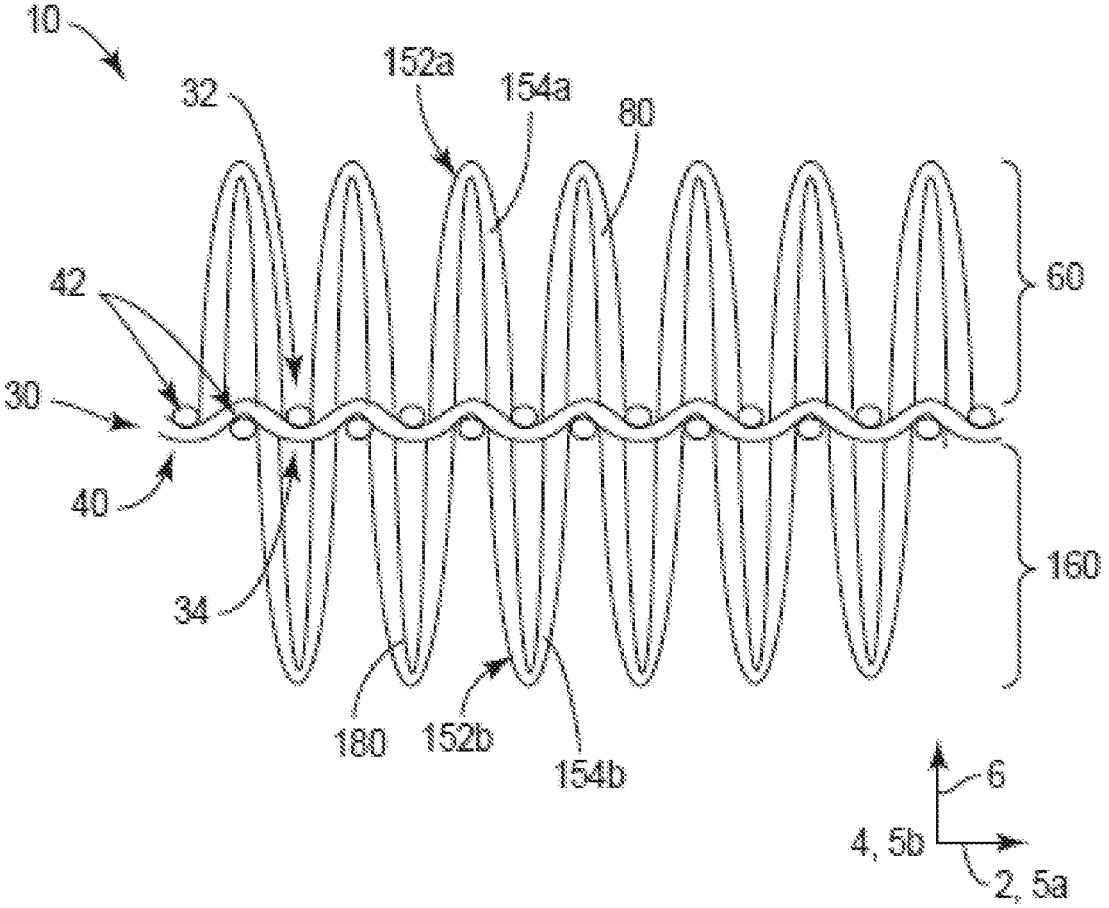
FIG. 3 is a cross-sectional view of an encircled portion of the terry article shown in FIG. 2.

As shown in FIGS. 1-3, the terry article 10 includes a ground component 30 and an upper pile component 60 and/or a lower pile component 160. The upper and lower pile components 60 and 160 include a plurality of piles 152*a*, 154*b* that are made up of plied yarns. A "pile" as used herein refers to a pile loop or a cut pile. As illustrated, the pile fabric includes pile loops. However, the pile fabrics can include cut piles as well. In the accordance with the illustrated embodiment, the plied yarns are two-ply yarns that includes a first yarn 62*a* and a second yarn 62*b* that are twisted together. The first yarn 62*a* may have a first yarn count (or be a coarse yarn). The second yarn 62*b* is primarily made of regenerated cellulose fibers and may have a second count that is less than (or finer) the first count. In other words, the first yarn 62*a* may be a coarse yarn and the second yarn 62*b* may be finer yarn made of regenerated cellulose fibers. The first yarn is typically made of cotton fibers but other fibers and fiber blends can be used as further explained below. The yarn configuration in the piles can yield a terry article 10 that is strong and absorbent, while also being soft and having sheen. The inventive terry articles and methods are surprisingly superior to existing so-called low-twist towels. In particular, there are challenges of weaving production and quality in 100% cotton low twist towels. The low yarn strength and elongation of the cotton yarns cannot withstand tension during weaving process. Apart from production problems, the softness of the 100% cotton low twist towels is inferior to the new inventive articles and methods as described herein.

The description and figures illustrate a towel article formed from a terry fabric as one example. However, terry articles—products made with or including terry fabrics—can include, but are not limited to, towels, bath robes, rugs, top of the bed fabrics, bath mats, and seat covers. The terry articles as described herein are suitable for home-uses, e.g. for products in bath or kitchen uses, commercial uses, such as towels designed for hotels, hospitality business, healthcare, and restaurants, and/or industrial uses.

Referring to FIG. 1, the terry article 10 includes a first end 12 and a second end 14 spaced from the first end 12 along a longitudinal direction 2, as well as a first side 16 and a second side 18. Both the first and second sides 16 and 18 extend from the first end 12 to the second end 14 along the longitudinal direction 2. The longitudinal direction 2 can also be referred to as the machine direction or the warp direction. The first and second sides 16 and 18 are spaced apart with respect to each other along a lateral direction 4 that is perpendicular to the longitudinal direction 2. The first and second ends 12 and 14 and first and second sides 16 and 18 collectively define a towel perimeter 19, which in turn defines a size and shape of the terry article 10. The terry article 10 also includes a first side 20 and a second side 22 opposed to the first side 20 along a vertical direction 6 that is perpendicular to the longitudinal and lateral directions 2 and 4, respectively. The terry article 10 has a length L that extends from the first end 12 to the second end 14 along the longitudinal direction 2 and a width W that extends from the first side 16 to the second side 18 along the lateral direction 4. As illustrated, the length L of the terry article 10 is greater than the width W, so as to define the shape of a bath towel or hand towel. The dimensions of the terry article 10 can be defined during manufacturing to be any particular size. For instance, the terry article 10 can be sized as a hand towel, or the terry article 10 can be sized as a bath towel.

Continuing with FIGS. 1-3, the terry article 10 includes a ground component 30 and at least one pile component. In the illustrated embodiment, the terry article 10 has an upper pile component 60 along the first side 20 of the terry article 10 and a lower pile component 160 along the second side 22 of the terry article 10. In some instances, the terry article 10 includes only one pile component on either the first side 20 or the second side 22. The ground component 30 includes a first side 32 and a second side 34 spaced from the first side 32 along the vertical direction 6. The upper pile component 60 can project away from the first side 32 of the ground component 30 along the vertical direction 6 in a first direction 8*a*. The lower pile component 160 can project from the second side 34 of the ground component 30 along the vertical direction 6 in a second direction 8*b*, which is opposite to the first direction 8*a*. The upper pile component 60 may be referred to as a first pile component and the lower pile component 160 may be referred to as a second pile component. The first and second ends 12 and 14 of the terry article 10;6 include hems 24*a* and 24*b*, respectively. The first and second sides 16 and 18 can include hems or selvages 26*a* and 26*b*, respectively. The terry article 10 may also include one or more optional borders 28 that extend from the first side 16 to the second side 18, or from the first end 12 to the second end 14 of the terry article 10. For example, the terry article 10 shown in FIG. 1 includes an optional first border 28*a* and an optional second border 28*b*.

As illustrated in FIGS. 1-3, the upper pile component 60 can extend across a majority (up to all) of the first side 20 of the terry article 10. Specifically, the upper pile component 60 may extend from the first end 12 to the second end 14. The upper pile component 60 may also extend from one hem 26*a* at the first side 16 to the opposing hem 26*b* at the second side 18 along the lateral direction 4. The upper pile component 60 therefore may define a substantial portion of the first side 20 of the terry article 10. Accordingly, the upper pile component 60 includes a plurality of piles 152*a* (up to all of the piles) located on the first side 32 of the ground component 30. In addition, the lower pile component 160 may extend along one or both of longitudinal and lateral directions 2 and 4 on the second side 34 of the ground component 30. As shown, the lower pile component 160 corresponds to the upper pile component 60 such that lower pile component 160 defines a substantial portion of the second side 22 of the terry article 10. Accordingly, the lower pile component 160 includes a plurality of piles 152*b* (up to all of the piles) on the second side 34 of the ground component 30. However, the lower pile component 160 may define any portion of the second side 22 of the terry article 10 as desired.

The ground component 30 includes a plurality of ground warp yarns 40 and a plurality of ground weft yarns 42 interwoven with the plurality of ground warp yarns 40. As shown, the ground warp yarns 40 may extend along a warp direction 5*a*, and the ground weft yarns 42 may extend along a weft direction 5*b*. The warp direction 5*a* is parallel to the longitudinal direction 2, while the weft direction 5*b* is parallel to the lateral direction 4. The ground component 30 may be defined by a number of woven structures. Exemplary woven structures for the ground component 30 include, but are not limited to, 1×1 plain weave, 2×1 rib weave, 2×2 rib weave, or 3×1 rib weave. As further explained below, the ground warp yarns 40 and the ground weft yarns 42 may each comprise one or more of natural fiber and a synthetic fiber. For instance, each of the ground warp yarns 40 may comprise natural fiber yarns, synthetic fiber yarns, or blended natural and synthetic fiber yarns.

The ground warp yarns 40 can be formed from any number of fiber types. For instance, the ground warp yarns 40 can be natural fiber yarns, synthetic fiber yarns, or natural and synthetic blended yarns. Synthetic yarns that have good moisture absorbency and/or moisture retention properties may in some instances be used to form the ground warp yarns 40. The natural fiber yarns that may be used to form the ground warp yarns 40 may include cotton fibers, flax, bamboo, hemp, or other natural fibers. Natural and synthetic blended yarns that may be used to form the ground warp yarns 40 can include blends of cotton and polyethylene terephthalate (PET) staple fibers, cotton and polylactic acid (PLA) staple fibers, and cotton and polypropylene (PP) staple fibers. However, the present disclosure is not limited to cotton blends. Other natural and synthetic blends that can be utilized include cotton and staple microfibers, or cotton and staple fibers with complex cross-sectional shapes. In another example, the natural and synthetic blended yarns can include cotton fibers in a core-spun construction with a synthetic filament comprising the core. The synthetic yarns may include rayon fibers (e.g. Modal, Lyocell), microfiber staple fibers, or blends of PET and polyamide microfibers.

The ground warp yarns 40 can be any type of spun yarn structure. For example, the ground warp yarns 40 can be ring spun yarns, open end yarns, rotor spun yarns, or filaments. In one embodiment, the ground warp yarns 40 can be Hygrocotton® brand yarns marketed by Welspun India Limited. Furthermore, the ground warp yarns 40 can be formed as disclosed in U.S. Pat. No. 8,733,075, entitled "Hygro Materials for Use In Making Yarns And Fabrics," (the '075 patent). The '075 patent is incorporated by reference into the present disclosure. The hygro yarns may comprise cotton fibers with an internal void or hollow core, and/or a porous structure. The ground warp yarns 40 may have a count in a range between about 6 Ne to about 60 Ne. In one example, the ground warp yarns 40 have a count of about 16 Ne. In another example, the ground warp yarns 40 have a count of about 20 Ne. In another example, the ground warp yarns 40 have a count of about 24 Ne. In another example, the ground warp yarns 40 have a count of about 30 Ne. In another example, the ground warp yarns 40 have a count of about 34 Ne. In another example, the ground warp yarns 40 have a count of about 40 Ne. In another example, the ground warp yarns 40 have a count of about 50 Ne. In addition, the ground warp yarns 40 can be plied yarns. In one example, the ground warp yarns 40 can include a 2-ply natural fiber yarn. In another example, the ground warp yarns 40 can include a 3-ply yarn.

The ground weft yarns 42 can be formed from a number of fiber types that have a variety of different yarn structures. For instance, the ground weft yarns 42 can be natural fiber yarns, synthetic yarns, or natural and synthetic blended yarns. The ground weft yarns 42 can be ring spun yarns, open end yarns, rotor spun yarns, or filaments. The ground weft yarns 42 can also be Hygrocotton® brand yarns marketed by Welspun India Limited. Further, the ground weft yarns 42 can be formed as disclosed in the '075 patent. The ground weft yarns 42 can have a count in a range between about 6 Ne to about 60 Ne. In accordance with the illustrated embodiment, the ground weft yarns 42 can be similar to the ground warp yarns 40 described above.

Figure 4:
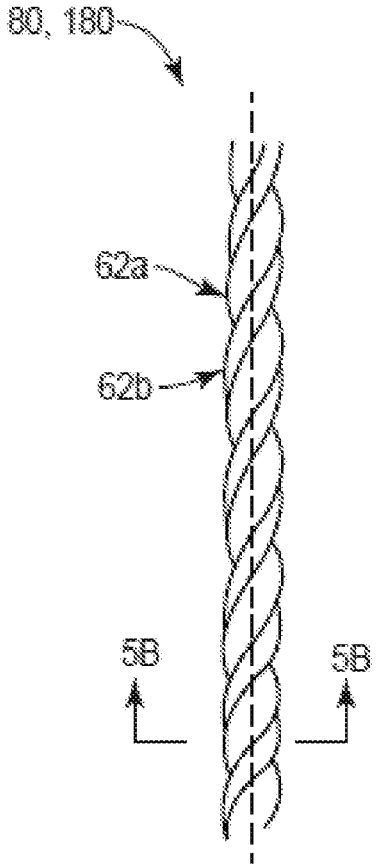
FIG. 4 is a schematic side view of a two-ply yarn used to form the terry article shown in FIGS. 1-3.
Figure 5:
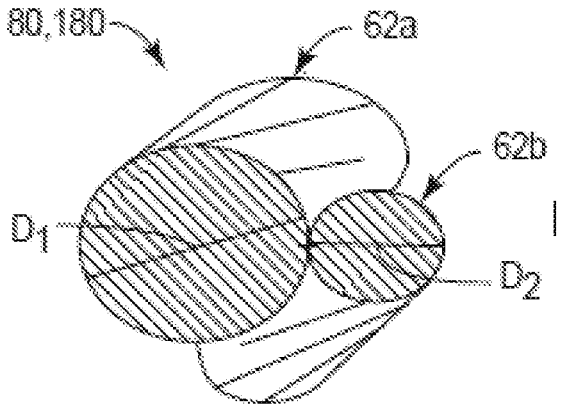
FIG. 5 is a cross-sectional view of the two-ply yarn taken along line 5-5 in FIG. 4.

Referring to FIG. 3-5, the terry fabric includes at least one pile component. As shown, the terry article includes upper and lower pile components 60 and 160. The upper and lower pile components include upper and lower piles 152*a* and 152*b*, respectively, that project in a direction away from the ground component 30. The piles 152*a*, 152*b* are defined by pile yarns 154*a* and 154*b*, respectively, that are interwoven with the ground component 30. The upper pile yarn 154*a* includes a plied yarn 80. The lower pile yarns 154*b* include plied yarns 180. The plied yarns 80 and 180 may substantially similar. The terminal ends of the upper and lower pile components 60 and 160 can define the first side 20 and the second side 22 of the terry article 10. The piles 152*a*, 152*b* of the upper and lower pile components 60 and 160 have a pile height H that extends from the ground component 30 to the terminal ends of the piles. The pile height H can range from 2 up to 12 millimeters (or more). Though the pile heights H of the upper and lower pile components 60 and 160 are depicted as being substantially equal, the upper and lower pile components 60 and 160 may have different heights H. The pile density of the piles 85 can range from 40 pile ends per inch to 80 pile ends per inch. However, the pile ends per inch is not limited to 80 pile ends per inch. For instance, the piles ends per inch can go up to about 240 pile ends per inch.

Referring to FIGS. 4-5, the upper pile component 60 and/or the lower pile component 160 may include a plied yarn made of a plurality of separate, packaged dyed yarns twisted together into a plied yarn configuration. In one embodiment, the plied yarn 80 comprises a first yarn 62*a* and a second yarn 62*b* twisted together into a plied yarn configuration.

The first yarn 62*a* may be comprised of staple fibers. In one example, the staple fibers may be natural fibers, such as cotton fibers. Alternatively, and merely for example, in place of cotton, the first yarn 62*a* may contain viscose fibers, modal fibers, silk fibers, and acrylic fibers. In another example, the staple fibers may be synthetic fibers, such as acrylic fibers. Alternatively, and merely for example, in place of acrylic fibers, the first yarn 62*a* may contain polyethylene terephthalate (PET) fibers or polyamide fibers. In a further example, the first yarn 62*a* may include staple fibers that comprise a fiber blend, such as a blend of natural and synthetic fibers. The fiber blends that may be used in the first yarn 62*a* may include, for example: blends of cotton and bamboo; blends of cotton and sea weed fibers; blends of cotton and silver fibers; blends of cotton and charcoal fibers; blends of PET fibers and cotton; blends of PET and regenerated cellulose fibers; blends of cotton and modal; blends of cotton; silk and modal; and any combinations thereof. The blends of natural and synthetic fibers that may be used in the first yarn 62*a* can define a ratio of natural fibers to synthetic fibers that ranges from about 90:10 to about 10:90. The first yarn 62*a* may also, for example, be 100% cotton or a combination of any of the foregoing blends. Additionally, the first yarn 62*a* may be preshrunk. Furthermore, the first yarn 62*a* can a hygro yarn formed as disclosed in the '075 patent. The '075 patent is incorporated by reference into the present disclosure. The hygro yarns may comprise cotton fibers with an internal void or hollow core, and/or a porous structure.

The second yarn 62*b* may be comprised primarily of regenerated cellulosic fibers. Regenerated cellulose fibers may include viscose rayon fibers, modal, bamboo fibers, and the like. In some instances, the second yarn 62*b* may comprise a blend that is predominantly regenerated cellulosic fibers and other fibers, including natural fibers or synthetic fibers. In such an example, the second yarn 62*b* can be at least 50% regenerated cellulosic fibers and the balance being one or more other fibers. Alternatively, the second yarn 62*b* can be from about 5% to about 95% regenerated cellulosic fibers and 5% to about 95% of one or more other fibers. Further, the second yarn 62*b* may be preshrunk.

As shown in FIG. 5, the first yarn 62*a* has a first yarn count, and the second yarn 62*b* has a second yarn count that is finer that the first yarn count. It should be appreciated that the first yarn 62*a* can define a first diameter D1 that is perpendicular to a central axis of the yarn 62*a* and the second yarn 62*b* defines a second diameter D2 perpendicular to a central axis of the yarn 62*b*. In the depicted embodiment, the second diameter $D_2$ is smaller than the first diameter D1. As such, the second yarn count of the second yarn 62*b* is lower (i.e. finer) than the first yarn count of the first yarn 62*a*. The first and second yarn counts may be between 10 Ne and 90 Ne. In one embodiment, the second yarn count can be between 60 and 90 Ne. In one embodiment, the first yarn 62*a* has a first yarn count less than 20 Ne, and the second yarn 62*b* has a second yarn count greater than 20 Ne. In another embodiment, the first yarn 62*a* has a first yarn count less than 30 Ne, and the second yarn 62*b* has a second yarn count greater than 30 Ne. In a further embodiment, the first yarn 62*a* has a first yarn count less than 40 Ne, and the second yarn 62*b* has a second yarn count greater than 40 Ne. In another embodiment, the first yarn 62*a* has a first yarn count less than 50 Ne, and the second yarn 62*b* has a second yarn count greater than 50 Ne.

The first and second yarns 62*a* and 62*b* each comprise spun yarns that have twisted configuration. The first and second yarns 62*a* and 62*b* may have twist in the "S" or "Z" direction. For example, the first and second yarns 62*a* and 62*b* may have a twist of about 3.5 twists per inch to about 15 twists per inch. However, regardless of which of the S and Z directions is utilized, the first and second yarns 62*a* and 62*b* will be twisted together in the plied yarn structure in a direction that is opposite to the twist direction of each yarn. As is known in the art, the twist multipliers is a function of both the twists per inch and the count for the first and second yarns. In one embodiment, the first twist multiplier of the first yarn 62*a* may be greater than the second twist multiplier of the second yarn 62*b*. In another embodiment, the second twist multiplier may be greater than the first twist multiplier.

As illustrated, the plied yarn 80 is a two-ply yarn that includes a first yarn 62*a* and a second yarn 62*b* twisted together with the first yarn 62*a*. However, the plied yarn 80 can have a number of alternative configurations compared to what is illustrated in the drawings and described further below. For instance, the plied yarn 80 can have more than two separate packaged dyed yarns. In one embodiment, the plied yarn 80 can be 3-ply yarn that has three separate packaged dyed yarns. In another example, the plied yarn 80 is a 4-ply yarn that has four separate packaged dyed yarns. In other example, the plied yarn 80 is a 5-ply yarn that has five separate packaged dyed yarns.

Further examples of the plied yarn 80 are described next. In one example, the plied yarn 80 may include two yarns twisted together, where one of the two yarns comprises regenerated cellulosic fibers and the other of the two yarns is a staple yarn or a continuous filament yarn. In another example, the plied yarn 80 has three yarns twisted together, where at least one of the three yarns comprises regenerated cellulosic fibers and the other yarns are staple yarns or continuous filament yarns. In yet another example, the plied yarn 80 has four yarns twisted together, where at least one of the four yarns comprises regenerated cellulosic fibers and the other yarns are staple yarns or continuous filament yarns. In another example, the plied yarn 80 has five yarns twisted together, wherein at least one of the five yarns comprises regenerated cellulosic fibers and the other yarns are staple yarns or continuous filament yarns. While the various configurations of the plied yarn 80 are described above to illustrate different implementations, for ease of illustration the plied yarn 80 is described herein and illustrated as a two-ply yarn having first and second yarns 62*a* and 62*b*.

Figure 6:
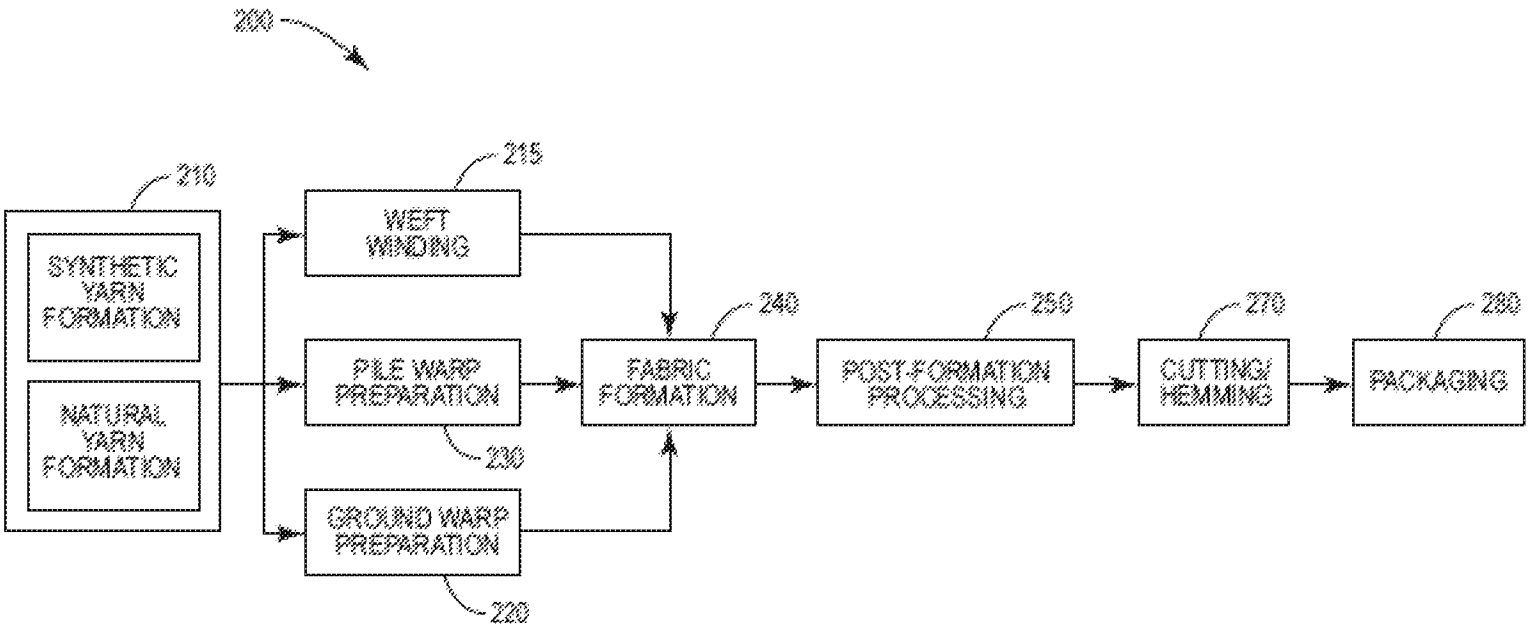
FIG. 6 is a process flow diagram illustrating process steps in the manufacture of the terry article shown in FIGS. 1-5.

A method of making a terry article according to an embodiment of the disclosure is illustrated in FIG. 6. The method 200 includes yarn formation 210 for processing: a) the ground warp yarns 40, b) the ground weft yarns 42, and c) the pile yarn 154*a*, 154*b*, which may be the plied yarn 80. In embodiments where the terry article 10 includes upper and lower pile components 60 and 160, the yarn formation 210 can include the step of forming additional pile yarns 154*b* for the lower pile component 160. Exemplary yarn formation phases will be described next.

During the yarn formation 210, the ground warp yarns 40 may be formed from any number of fiber types. The ground warp yarns 40 can be formed primarily with natural fibers, natural and synthetic blended fibers, and synthetic fibers or yarns with good moisture absorbency and/or retention properties. In one example, the ground warp yarns 40 are formed primarily from natural fibers, such as cotton.

The yarn formation 210 for the ground warp yarns 40 can include various staple yarn spinning operations. Examples of such yarn spinning operations (not illustrated) may include bale opening, carding, combing, drafting, roving, and yarn spinning to the desired count and twist level. In some cases, the ground warp yarns 40 can be plied into 2-ply, 3-ply, or 4-ply configurations. In one example, ring spinning is the preferred spinning system used in the ground warp preparation step 220. However, the ground warp yarns 40 can be formed open end spinning systems, rotor spun spinning systems, or vortex spinning systems. Furthermore, the ground warp preparation step 220 may include methods to form the Hygrocotton®, as disclosed in the '075 patent. After the yarn formation 210, the ground warp yarns 40 are wound into yarn packages for the ground warp preparation step 220.

During yarn formation 210, the ground weft yarns 42 may be formed with similar fiber types and using the same or similar yarn spinning systems as those used to form the ground warp yarns 40. As needed, the ground weft yarns 42 may be plied in 2-ply, 3-ply, or 4-ply configurations. Following the spinning of the ground weft yarns 42, the ground weft yarns 42 are wound onto desired packages in the weft winding step 215. The wound packages are then staged for weft insertion during fabric formation steps 240, which are discussed further below.

Yarn formation 210 also include includes forming the first and second yarns 62*a* and 62*b* used as the pile yarns 75. Each of the first and second yarns 62*a* and 62*b* may be pre-twist in either the S or Z direction, such that after spinning the first and second yarns 62*a* and 62*b*, each have a respective count and twist multiplier, as described above. The first yarns 62*a* may be formed from a variety of fiber types, such as natural fibers, synthetic fibers, or fiber blends as described above. The second yarns 62*b* may be entirely comprised of regenerated cellulosic fibers, or may include a blend regenerated cellulosic fibers and other fiber types. Preferably, the second yarn at least 50% up to 100% of regenerated cellulosic fibers.

The yarn formation 210 further includes forming the plied yarns 80 for use in the upper pile component 60 and/or lower pile component 60 as piles 75. In terry articles 10 including both an upper pile component 60 and a lower pile component 160, plied yarns 80 are used in the upper and lower pile components. Forming plied yarns include twisting together the first yarn 62*a* and the second yarn 62*b* into a plied yarn configuration. As mentioned above, the first and second yarns 62*a* and 62*b* are spun to have twist in one of the S and Z directions. In the step of forming the plied yarns 80, the first and second yarns 62*a* and 62*b* are twisted together in direction opposite to the direction the first and second yarns 62*a* and 62*b* are twisted. For instance, in one example, the first and second yarns 62*a* and 62*b* are each twisted in the S-direction and the two yarns are twisted together in the Z-direction. In another example, the first yarn 62*a* and second yarn 62*b* are each twisted in the Z-direction and the two yarns are twisted together in the Z-direction. Forming the plied yarns can also include letting off excess amounts of the second yarn 62*b*, which can cause the plied yarns to be fuller and more open. As illustrated, the plied yarns formed in the yarn formation 210 may be the same for both the upper and lower pile components 60 and 160. However, the plied yarns formed in the yarn formation 210 may be different for the upper and lower pile components 60 and 160, respectively. Although a 2-ply configuration is described, yarn formation 210 can alternatively include plying the multiple sets of yarns into 3-ply or 4-ply configurations.

After yarn formation 210, the method continues to a weft winding step 215. The weft winding step 215 may include one or more steps, whereby the ground weft ends are removed from their respective yarn packages, arranged in a parallel form, and wound onto a ground weft beam. The weft winding step 215 may also include a sizing step where a typical sizing agent is applied to each ground warp yarn to aid in fabric formation.

Following the weft winding step 215, the method proceeds to a ground warp preparation step 220 and a pile warp preparation step 230. The ground warp preparation step 220 includes one or more ground warping steps, whereby the ground yarn ends are removed from their respective yarn packages, arranged in a parallel form, and wound onto a ground warp beam. The ground warp preparation step 220 also includes a sizing step where a typical sizing agent is applied to each ground warp yarn to aid in fabric formation. The ground warp preparation step 220 results in a warp beam of ground warp yarns 40 prepared for weaving. The ground warp beam can be positioned on a mounting arm of a weaving loom so that the ground warp yarns can be drawn through the loom components, as further described below.

The pile warp preparation step 230 includes similar steps to the ground warp preparation steps 220, i.e., warping and sizing. In particular, the pile warp preparation step 230 includes the steps of warping and sizing the pile yarns 75. For embodiments of terry articles 10 that include upper and lower pile components 60 and 160, the pile warp preparation step 230 includes preparing two separate pile warp beams: one upper pile warp beam and one lower pile warp beam. The upper pile warp beam is dedicated to forming the upper pile component 60, and the one lower pile warp beam is dedicated to forming the lower pile component 160. The ground and pile warp beams are positioned on respective mounting arms or mounting brackets proximate the weaving loom (not shown).

Continuing with FIG. 6, fabric formation 240 includes forming the ground component 30 and the upper pile component 60 and/or lower pile component 160 using a weaving loom designed for terry weaving. More specifically, in fabric formation 240, each ground warp yarn 40 and pile warp yarn from the respective warp beams are drawn-in (not shown) through various components of a weaving loom, such as drop wires, heddle eyes attached to a respective harness, reed and reed dents, in a designated order as is known in the art.

After drawing-in is complete, the fabric formation 240 proceeds through two phases: a ground component formation phase and a pile component formation phase. Both phases include a particular shedding motion to facilitate interweaving the ground weft yarns 42 with the ground warp yarns 40 and pile warp yarns to create the desired pile fabric construction. For instance, shedding motions can include cam shedding, dobby shedding, or jacquard shedding motions, each of which can cause the selective raising and lowering of warp ends to create an open shed for weft insertion. In one example, the weaving loom may be configured for one type of shedding motion for the ground warp yarns and another type of shedding motion for the pile warp yarns. For instance, a cam or dobby shedding motion can be used for the ground warp yarns and the jacquard shedding motions can be used for the pile warp yarns. A specific reed motion and warp take-off system is utilized to form the piles during the pile component phase and such a mechanism using a terry weaving loom is well known and will not be repeated here.

During the ground component phase of the fabric formation steps 240, the ground weft yarns 42 are interwoven with the ground warp yarns 40 to define the ground component 30 or ground fabric. Exemplary ground fabric woven constructions include: a 1×1 plain weave, 2×1 rib weave, 2×2 rib weave, or 3×1 rib weave. Other woven constructions in the ground fabric are possible as well. The ground component formation phase can utilize different weft insertion techniques, including air-jet, rapier, or projectile type weft (fill) insertion techniques.

The pile component phase of the fabric formation steps 240 include interweaving the pile yarns 75 (via the first warp) with the ground warp and weft yarns 40 and 42 to create a pile fabric having a first set of piles 152*a* that extend away from the ground component 30 along the vertical direction 6. Because plied yarns 80 are used to create the piles 152*a*, the piles 152*a* may have a spiral shape. The fabric formation can also include forming a second set of piles 152*b* that extend away from the ground component 30 along the vertical direction 6. The fabric formation steps 240 can further include optional step of weaving one or more borders 28 (such as first and second borders 28*a* and 28*b*) across a length L, width W, or along other directions that are angularly offset with respect to the length L and width W of the pile fabric. Forming such a border includes weaving the border 28 with a weft or pick density that is three or more times greater than the pick density of adjacent portions of the pile fabric. The fabric formation steps 240 can further include optionally weaving one or more hems (such as hems 24*a*, 24*b*, 26*a*, and 26*b*) along a length L of the pile fabric.

The fabric formation steps 240 can be used to form pile fabrics having any number of different fabric constructions. In one example, the pile fabric is formed to result in a 3-pick up to 7-pick (or more) terry weave pattern. Furthermore, the pile fabric can have a 1:1 warp order where each ground warp end is followed by a pile warp end across the width of the pile fabric. In other embodiments, the pile fabric can have a 2:2 warp order where a pair of ground warp ends are followed by a pair of pile warp ends across the width of the pile fabric. In one example, the pile fabric can be formed to include between about 15 to about 45 ends/cm, preferably between about 20 and 30 ends/cm. The weft or pick density can range between about 10 picks/cm to about 30 picks/cm. Preferably, the pick density is between about 15 picks/cm to about 25 picks/cm.

In embodiments with upper and lower pile components 60 and 160, the fabric formation steps 240 further include forming the pile fabric by forming the upper pile component 60 on the first side 32 of the ground component 30 and forming the lower pile component 160 on the second side 34 of the ground component 30. As noted above, the upper and lower pile components 60 and 160 may be formed of pile yarns 154*a*, 154*b*, which can be plied yarns 80, 180, respectively.

Following fabric formation steps 240, the pile fabric is subjected to a post-formation processing step 250. The post-formation processing step 250, may also include a de-sizing step, a bleaching step, a dyeing step, and/or a washing step. In another example, the post-formation processing step 250 includes a dyeing phase. For instance, the dyeing phase may include applying reactive dyes to natural fiber yarns, and cotton yarns in particular, at elevated temperatures sufficient to cause yarn shrinkage. Either batch, semi-continuous, or continuous dyeing systems can be used to apply reactive dyes to the pile fabric. Other dyes can be used depending on the particular fiber blend. The dyeing and finishing phase could also include printing as needed.

The post-formation processing step 250 may also include a finishing phase where various functional finishes or agents are added to the pile fabric to improve or augment performance characteristics of the terry article 10. In one example, the pile fabric can be treated with a hydrophilic agent, such as silicones. In another example, the finishing step includes application of one or more softeners to the fabric, such as cationic softeners, non-ionic softeners, and silicones. In another example, the finishing step includes application of an antimicrobial agent to the pile fabric. In accordance with one embodiment, the finishing step could also include the thermal treatment that causes shrinkage of the piles 85. In accordance with one embodiment, after the dyeing and finishing phases of the post-formation processing step 250, a drying step is used to remove moisture from the pile fabric. The drying step also includes a thermal treatment step that can cause shrinkage of the continuous filament yarns that may cause the second set of piles to shrink. For example, when the pile fabrics include non-heat set yarns in pile components 60 and 160, a treatment step that dries the fabric may also cause the piles 85 to shrink, as explained above.

It should be appreciated that in some case, dyes and functional finishes can be applied to the fabric in any particular order. For example, functional agents can be applied along with the application of the dyes, before application of the dyes, or after application on the dyes. It should be appreciated that dyeing, finishing, and drying phases of step 250 may be in-line and considering a continuous process step.

Following the post-formation processing step 250, the method includes a cutting step 270 where the pile fabric is cut to the size of one or more terry articles 10, such as a bath towel, a hand towel, and a washcloth. Following the cutting step 270, additional edge binding or hems (such as hems 24*a*, 24*b*, 26*a*, and 26*b*) can be applied to finish the cut edges. After the cutting step, a packing step 280 places the finished terry articles 10 in suitable packaging for shipment.

Another exemplary method of making a terry article includes spinning a first yarn to have a first yarn count and spinning a second yarn to have a second yarn count that is finer than the first yarn count, wherein the second yarn includes regenerated cellulosic fibers. The method may include plying the first yarn and the second yarn together to form a plied yarn. The method further includes weaving a pile fabric including a ground component and a pile component disposed on at least one of a first side and a second side of the ground component, wherein the pile component comprises a plurality of piles formed with the plied yarn such that each pile includes 1) a first yarn having the first yarn count, and 2) a second yarn having the second yarn count that is finer than the first yarn count. As noted above, the first yarn includes natural fibers. In another example, the first yarn includes cotton fibers. In yet another example, the first yarn includes synthetic fibers. In yet another example, the first yarn includes a blend of natural and synthetic fibers. In one example, the second yarn is primarily regenerated cellulose fibers. In yet another example, the second yarn includes a blend of the regenerated cellulose fibers and one or more of synthetic fibers and natural fibers.

Exemplary constructions consistent with the present disclosure were formed and various tests were performed to evaluate the properties of the such constructions. Table 1 below illustrates the data obtained from for an exemplar plied yarn used in the piles. Example A includes a 1/13 Ne combed cotton yarn as the first yarn 62*a* in the piles and a 60 Ne regenerated cellulose yarns as the second yarn 62*b* in piles. Example B includes a 1/13 Ne combed cotton yarn as the first yarn 62*a* in the piles and a 60 Ne cotton yarn as the second yarn 62*b*. The yarns summarized below were used to manufacture pile fabrics as disclosed herein.

TABLE 1

| | Test Data | Example A | Example B |
|---|---|---|---|
| Wrapping Test Results | Average Count for the Plied Yarn | 10.64 | 10.98 |
| | Avg. Strength | 241.43 | 157.3 |
| | CSP | 2569 | 1727 |
| | Count Cv % | 0.44 | 0.98 |
| | Strength Cv % | 1.22 | 1.42 |
| T.P.I.Test Results | Average T.P.I. | 8.46 | 8.61 |
| | T.P.I. Cv % | 1.93 | 0.75 |
| | T.M | 2.59 | 2.6 |
| UTR-3 Test Results | Avg. BF (gms) | 986.3 | 602.1 |
| | Avg. R.Km (Nm * Kgf). | 17.77 | 11.2 |
| | Min. R.Km (Nm * Kgf). | 15.73 | 9.26 |
| | R.Km Cv % | 6.2 | 11.17 |
| | Elongation % | 7.6 | 3.35 |
| | Elongation Cv % | 9.37 | 8.1 |

While the disclosure is described herein using a limited number of embodiments, these specific embodiments are not intended to limit the scope of the disclosure as otherwise described and claimed herein. The precise arrangement of various elements and order of articles and methods described herein are not to be considered limiting. For instance, although the steps of the methods are described with reference to sequential series of reference signs and progression of the blocks in the figures, the method can be implemented in any particular order, as desired.

What is claimed:

1. A terry article comprising:

a ground component including a plurality of ground warp yarns and a plurality of ground weft yarns interwoven with the plurality of ground warp yarns, the ground component including a first side and a second side opposite to the first side along a vertical direction; and a pile component extending away from the ground component along the vertical direction, the pile component having a plurality of plied yarns, each of the plied yarns including 1) a first yarn that has a first yarn count less than 20 Ne, and 2) a second yarn separate from the first yarn and that has a second yarn count that is greater than 20 Ne, the first yarn and the second yarn being packaged dyed yarns twisted together, and wherein the second yarn is entirely made up of regenerated cellulose fibers.

2. The terry article of claim 1, wherein the first yarn includes natural fibers.

3. The terry article of claim 1, wherein the first yarn includes cotton fibers.

4. The terry article of claim 1, wherein the first yarn includes synthetic fibers.

5. The terry article of claim 1, wherein the first yarn includes a blend of natural and synthetic fibers.

6. The terry article of claim 1, wherein the second yarn is primarily regenerated cellulose fibers.

7. The terry article of claim 1, wherein the second yarn includes a blend of the regenerated cellulose fibers and one or more of synthetic fibers and natural fibers.

8. The terry article of claim 1, wherein in the pile yarn each of the first yarn and the second yarn are twisted in one of an S direction and a Z direction and the plied yarn is twisted together in the other of the S direction and Z direction.

9. The terry article of claim 1, wherein the pile component is an upper pile component that is disposed on the first side, wherein the terry article further comprises a lower pile component extending away from the second side of the ground component along the vertical direction.

10. A terry article comprising:

a ground component including a plurality of ground warp yarns and a plurality of ground weft yarns interwoven with the plurality of ground warp yarns, the ground component including a first side and a second side opposite to the first side along a vertical direction; and a pile component extending away from the ground component along the vertical direction, the pile component having:

a first plied yarn including a first yarn that has a first yarn count less than 50 Ne, and a second yarn that has a second yarn count that is greater than 50 Ne wherein the second yarn is entirely made up of regenerated cellulose fibers, and a second plied yarn including a third yarn that has a third yarn count less than 50 Ne, and a fourth yarn that has a fourth yarn count that is greater than 50 Ne, wherein the fourth yarn is entirely made up of regenerated cellulose fibers.

11. The terry article of claim 10, wherein the first yarn and the third yarn includes natural fibers.

12. The terry article of claim 10, wherein the first yarn and the third yarn includes cotton fibers.

13. The terry article of claim 10, wherein the first yarn and the third yarn includes synthetic fibers.

14. The terry article of claim 10, wherein the first yarn and the third yarn include a blend of natural and synthetic fibers.

15. The terry article of claim 10, wherein the pile component is an upper pile component that is disposed on the first side, wherein the terry article further comprises a lower pile component extending away from the second side of the ground component along the vertical direction.

* * * * *